US012269672B2

(12) United States Patent
König et al.

(10) Patent No.: US 12,269,672 B2
(45) Date of Patent: Apr. 8, 2025

(54) TRANSPORT CONTAINER FOR CONCENTRATED HYDROGEN PEROXIDE

(71) Applicant: EVONIK OPERATIONS GMBH, Essen (DE)

(72) Inventors: Bernhard König, Gelnhausen (DE); Jürgen Glenneberg, Offenbach (DE); Philipp Christ, Dieburg (DE); Anna Kunkel, Linsengericht (DE); Bernd Gottschlich, Betzdorf (DE)

(73) Assignee: Evonik Operations GmbH, Essen (DE)

( * ) Notice: Subject to any disclaimer, the term of this patent is extended or adjusted under 35 U.S.C. 154(b) by 0 days.

(21) Appl. No.: 17/766,393

(22) PCT Filed: Sep. 30, 2020

(86) PCT No.: PCT/EP2020/077350
§ 371 (c)(1),
(2) Date: Apr. 4, 2022

(87) PCT Pub. No.: WO2021/069275
PCT Pub. Date: Apr. 15, 2021

(65) Prior Publication Data

US 2023/0391543 A1 Dec. 7, 2023

(30) Foreign Application Priority Data

Oct. 7, 2019 (DE) ..... 20 2019 004 097.8

(51) Int. Cl.
*B65D 88/12* (2006.01)
*B65D 90/00* (2006.01)
(Continued)

(52) U.S. Cl.
CPC ..... *B65D 88/128* (2013.01); *B65D 90/0033* (2013.01); *B65D 90/20* (2013.01); *B65D 90/34* (2013.01); *B65D 90/54* (2013.01)

(58) Field of Classification Search
CPC ..... F17C 1/002; F17C 3/025; B65D 90/20; B65D 90/0033; B65D 88/128; B65D 90/34; B65D 90/54
See application file for complete search history.

(56) References Cited

U.S. PATENT DOCUMENTS 4,065,022 A 12/1977 Cainaud
4,853,013 A 8/1989 Rio et al.
(Continued)

FOREIGN PATENT DOCUMENTS

CN 101932515 12/2010
CN 201799268 4/2011
(Continued)

OTHER PUBLICATIONS

English language translation of the International Search Report for corresponding PCT/EP2020/077350 filed Sep. 30, 2020.
(Continued)

*Primary Examiner* — Shawn M Braden
(74) *Attorney, Agent, or Firm* — Grüneberg and Myers PLLC

(57) ABSTRACT

The transport container for concentrated hydrogen peroxide comprises: a cuboid carrier frame; a liquid container provided inside the carrier frame (1) and frictionally connected thereto, said container having an internal volume of between 65 and 500 l and consisting of pure aluminium, chromium-nickel steel, a nickel-based alloy, or a steel coated with a polyolefin or clad on the inner face; a pressure equalisation device and a pressure relief valve, both of which are provided on the upper face of the liquid container; and at
(Continued)

least one sealable opening of the liquid container for the charging and/or removal of hydrogen peroxide.

20 Claims, 1 Drawing Sheet

(51) Int. Cl.

| | |
|---|---|
| ***B65D 90/20*** | (2006.01) |
| ***B65D 90/34*** | (2006.01) |
| ***B65D 90/54*** | (2006.01) |

(56) References Cited

U.S. PATENT DOCUMENTS

| | | | | |
|---|---|---|---|---|
| 8,960,484 | B2 * | 2/2015 | Spencer | B60P 3/22 220/586 |
| 2004/0112439 | A1 | 6/2004 | Eisenhut et al. | |
| 2006/0090815 | A1 | 5/2006 | Sakraschinsky et al. | |
| 2008/0006636 | A1 * | 1/2008 | Wild | B65D 77/061 220/9.1 |
| 2009/0242576 | A1 * | 10/2009 | Marcel | B65D 90/0033 220/647 |
| 2019/0002195 | A1 * | 1/2019 | Cox | B65D 90/48 |
| 2019/0062159 | A1 | 2/2019 | Kamimura | |

FOREIGN PATENT DOCUMENTS

| | | |
|---|---|---|
| CN | 106763761 | 5/2017 |
| CN | 109665219 | 4/2019 |
| EP | 0178136 | 4/1986 |
| EP | 0 280 611 | 8/1988 |
| JP | 2000062894 | 2/2000 |
| RU | 1 777 592 | 11/1992 |
| RU | 2 315 703 | 1/2008 |
| RU | 176 830 | 1/2018 |
| WO | 02/064454 | 8/2002 |
| WO | 2004/035343 | 4/2004 |

OTHER PUBLICATIONS

English language translation of the Written Opinion of the International Searching Authority for corresponding PCT/EP2020/077350 filed Sep. 30, 2020.

English language translation of the International Preliminary Report on Patentability for corresponding PCT/EP2020/077350 filed Sep. 30, 2020.

Russian Office Action dated Feb. 6, 2024, in Russian Application No. 2022112450/11, with partial English translation, 11 pages.

Russian Office Action received for Russian Patent Application No. 2022112450, mailed on Sep. 30, 2024, 3 pages.

* cited by examiner

TRANSPORT CONTAINER FOR CONCENTRATED HYDROGEN PEROXIDE

CROSS REFERENCE TO RELATED APPLICATIONS

The present application is US national stage of international application PCT/EP2020/077350, which had an international filing date of Sep. 30, 2020 and which was published on Apr. 15, 2021. The PCT application claims priority to DE 20 2019 004 097.8, filed on Oct. 7, 2019. The content of these prior filings is hereby incorporated by reference in its entirety.

TECHNICAL FIELD

The invention provides a transport container for transporting concentrated hydrogen peroxide having a content of more than 60 wt %.

PRIOR ART

Concentrated hydrogen peroxide is typically transported in pure aluminum bottles in the case of small amounts, and in tank containers or tanker trucks with tanks of stainless steel in the case of large amounts. However, transport containers suitable for transporting concentrated hydrogen peroxide and having a volume in the range from 65 to 500 I, which have the necessary approval under transport law and which meet the ADR packing instructions P501, are not available commercially.

SUMMARY OF THE INVENTION

A subject of the invention is a transport container for concentrated hydrogen peroxide, comprising (a) a cuboidal retaining frame (1), (b) a liquid container (2) disposed within the retaining frame (1), frictionally connected to the retaining frame, having an internal volume of 65 to 500 I, and consisting of pure aluminum with an aluminum content of at least 99 wt %, of a chromium-nickel steel, of a nickel-base alloy containing molybdenum and chromium, or of a steel lined or coated with a polyolefin on the inside, (c) a pressure equalization device (3) disposed on the top face of the liquid container (2), (d) a pressure relief valve (4) disposed on the top face of the liquid container (2), and (e) at least one closable opening (5) of the liquid container (2) for charging with hydrogen peroxide and/or removal of hydrogen peroxide.

DESCRIPTION OF THE INVENTION

Figure 1:
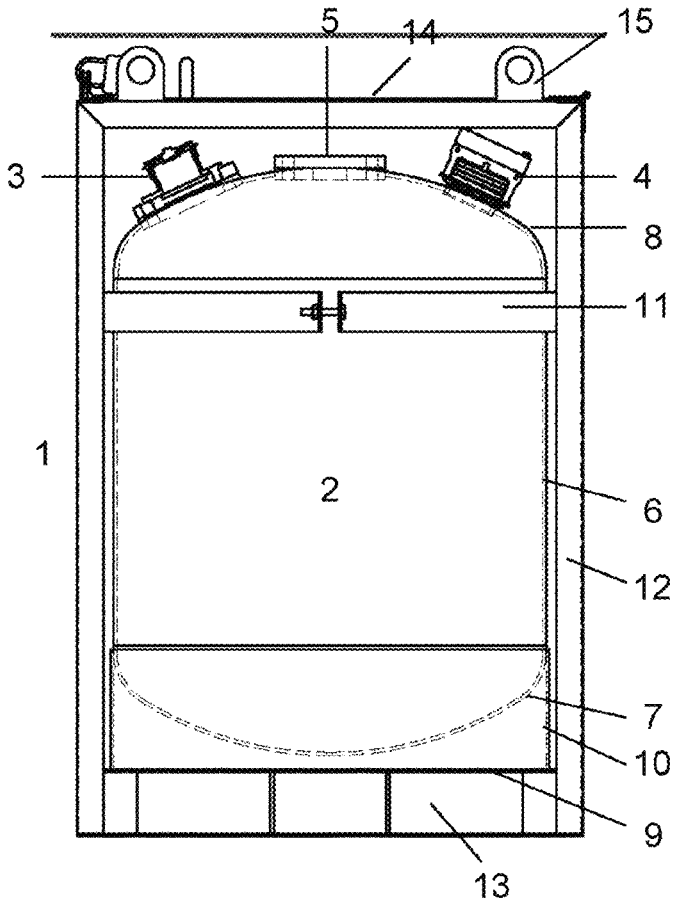
FIG. 1 shows a side view of a transport container of the invention.

The transport container of the invention comprises a cuboidal retaining frame (1) and a liquid container (2) which is disposed within the retaining frame (1) and is frictionally connected to the retaining frame.

The liquid container (2) may consist of pure aluminum with an aluminum content of at least 99 wt %. A pure aluminum with an aluminum content of at least 99.5 wt % is preferably used. A liquid container made of pure aluminum for the transport of hydrogen peroxide is pretreated preferably by an etching operation which erodes metal from the inner container wall. Particularly preferred in this context are an alkaline pretreatment and a subsequent treatment with a mixture containing phosphoric acid, hydrofluoric acid and hydrogen peroxide.

The liquid container (2) may alternatively also consist of a chromium-nickel steel. Preference in that case is given to austenitic chromium-nickel steels, more particularly to chromium-nickel steels having the EN 10027-2:1992 material numbers 1.4401 and 1.4571. A liquid container made from chromium-nickel steel for the transport of hydrogen peroxide is preferably subjected to oxidative pretreatment. Pretreatment with a mixture comprising nitric acid and hydrofluoric acid is particularly preferred.

In a third alternative, the liquid container (2) may consist of a nickel-base alloy containing molybdenum and chromium. Suitable base alloys are available under the brand name Hastelloy C.

In a fourth alternative, the liquid container (2) may consist of a steel which is lined or coated with a polyolefin on the inside. Preference in this case is given to a container made from a chromium-nickel steel with a polyolefin coating adhering on the whole of the inside face of the container. The polyolefin is preferably a fluorinated polyolefin, more preferably polytetrafluoroethylene (PTFE), polyvinylidene difluoride (PVDF) or a tetrafluoroethylene-perfluoroalkoxyvinyl ether copolymer (PFA).

The liquid container (2) is preferably made of pure aluminum, since after the container has been cleaned, hydrogen peroxide solutions having a low peroxide stabilizer content can also be safely transported in the container.

The liquid container (2) has an internal volume of 65 to 500 I, preferably of 65 to 250 I. The liquid container preferably has a cylindrical shape, more preferably the form of an upright cylinder (6) with domed base (7) and lid (8). Base (7) and lid (8) are preferably welded to the cylinder (6). The wall thickness of the liquid container is selected preferably such that the liquid container withstands a pressure difference between the container interior and the atmosphere surrounding the container of at least 2.5 bar, preferably at least 1.5 bar, and also withstands a fall of the transport container from a height of 2 m.

Disposed on the top face of the liquid container (2) are a pressure equalization device (3) and a pressure relief valve (4).

A suitable pressure equalization device (3) in the sense of the invention is any device which enables the passage of gas between the container interior and the atmosphere surrounding the liquid container and which therefore enables pressure equalization in the case of a pressure difference of less than 50 mbar. The pressure equalization device (3) is implemented preferably in such a way that there is pressure equalization in the case both of an overpressure and of an underpressure in the container, preferably for a pressure difference of less than 30 mbar, more preferably less than 10 mbar. The pressure equalization device (3) is most preferably implemented in such a way that it has a free gas passage even when there is no pressure difference between the container interior and the atmosphere surrounding the liquid container. The pressure equalization device (3) preferably comprises a particle filter in order to prevent particulate solids passing from the ambient air into the liquid container (2) in the event of pressure equalization, such particles being able to bring about decomposition of hydrogen peroxide in the liquid container (2). The particle filter consists preferably of a low-flammability material, and is preferably a sintered filter made from metal, glass, ceramic or a hydrophobic polymer, more preferably a fluorinated polymer, and very preferably PTFE. Alternatively or in combination with a sintered filter, it is also possible to use a nonwoven filter or woven fabric filter made from a hydrophobic polymer, preferably a fluorinated polymer, and more preferably PTFE.

The pressure equalization device (3) may additionally comprise a device which closes the pressure equalization device if liquid passes from the container side into the pressure equalization device, in order to prevent liquid running out from the pressure equalization device in the event of the transport container (1) falling over. Alternatively it is possible, for the same purpose, to use a filter made from a hydrophobic polymer, e.g., PTFE, with a small pore size, with which the passage of liquid hydrogen peroxide through the filter material requires a differential pressure of more than 200 mbar.

Suitable pressure equalization devices (3) are known from storage tanks for hydrogen peroxide and from relatively large transport tanks for hydrogen peroxide and are available commercially, as for example from the company PEROLO under the designation "H2O2 Breather".

A pressure relief valve (4) in the sense of the invention is a valve which enables gas passage only at a defined overpressure of more than 0.1 bar in the container interior and which remains closed in the case of a lower pressure difference or an underpressure in the liquid container. The pressure relief valve (4) is preferably implemented in such a way that it opens when a limiting value for the overpressure in the liquid container (2) relative to the surrounding atmosphere in the range from 0.1 to 2.5 bar, more preferably from 0.5 to 2 bar, more particularly of 1.5 bar, is exceeded. The pressure relief valve (4) is preferably implemented in such a way that it closes again automatically when the value for the overpressure is below the limiting value. Preferred pressure relief valves (4) are those which open and close by means of a spring mechanism which is actuated by the overpressure in the liquid container (2) and requires no auxiliary energy. The pressure relief valve (4) is preferably implemented in such a way that in the opened state it provides clearance for a passage opening having a cross section of at least 3 $cm^2$, preferably of 4 to 200 $cm^2$. In the event of rapid decomposition of hydrogen peroxide in the liquid container (2), the pressure relief valve (4) allows the escape of oxygen and water vapor formed in such a decomposition, and, in the case of such decomposition, prevents the pressures in the liquid container rising to pressures which could cause the container to burst. Suitable pressure relief valves (4) are known from storage tanks for hydrogen peroxide and from relatively large transport tanks for hydrogen peroxide and are available commercially, as for example from the company PEROLO under the designation "YAK VX safety relief valve".

The liquid container (2) additionally has at least one closable opening (5) in the liquid container (2) for charging with hydrogen peroxide and/or removal of hydrogen peroxide. The closable opening (5) is disposed preferably on the top face of the liquid container (2) and is closed preferably with a lid which preferably provides gastight closure. The lid may be secured, for example, by screwing or with a clamping ring over the opening. The closable opening is preferably implemented with a flange on which a fitting which closes the opening, for the removal of hydrogen peroxide, may be secured. A fitting of this kind preferably comprises a dip tube which reaches close to the base of the liquid container (2) and through which hydrogen peroxide can be pumped off from the transport container (19. Alternatively to a closable opening (5) on the top face of the liquid container (2) or in addition to such an opening the liquid container (2) may also have a closable opening (5) disposed on the bottom face, this opening being closable by means of a shutoff fitting. The shutoff fitting in this case may be implemented as a shutoff tap or as a valve.

The liquid container (2) of the transport container of the invention is disposed within a cuboidal retaining frame (1) and is connected frictionally to the retaining frame (1). The frictional connection between the retaining frame (1) and the liquid container (2) may be accomplished via straps on the liquid container (2), which are screwed to the retaining frame (1), or, preferably, by clamping devices which are secured on the retaining frame (1) and into which the liquid container (2) is clamped. The liquid container (2) may be connected to the retaining frame (1) via one or more shock absorbers.

In one preferred embodiment the liquid container (2) has the form of an upright cylinder (6) with domed base (7) and lid (8), and at the bottom end of the liquid container a circumferential ring (10) is secured, preferably by being welded to the liquid container (2). In this embodiment the retaining frame comprises a base (9), on which the circumferential ring (10) of the liquid container (2) stands up. The base (9) of the retaining frame may be implemented continuously or in latticed form. Alternatively the base of the retaining frame may also be implemented around its circumference with a central opening below the liquid container (2). By means of the construction with a circumferential ring (10) which stands up on the base (9), the weight force of the liquid container (2) can be dissipated uniformly via the circumferential ring (10) onto the retaining frame, and a point loading of the liquid container (2) by the weight force can be avoided. In the case of this embodiment, the liquid container (2) is connected frictionally to the retaining frame (1), preferably by a clamping ring (11) placed around the cylinder (6), and this likewise prevents point loading of the liquid container (2). An advantage of the embodiment having a clamping ring (11) placed around the cylinder (6) is that the liquid container (2) can be easily installed in the retaining frame (1) by the introduction of the liquid container (2) from above into the retaining frame (1) with the clamping ring (11) opened, until the circumferential ring (10) is seated on the base (9) of the retaining frame and subsequently the liquid container (2) is connected frictionally to the retaining frame (1) by closing of the clamping ring (11). The circumferential ring (10) of the liquid container (2) may have additional straps on its bottom edge, allowing it to be connected frictionally to the base (9) of the retaining frame in order to prevent the liquid container (2) slipping on the base (9).

The retaining frame (1) preferably comprises metal profiles (12) on the edges of the cuboidal retaining frame, preferably made from steel, more preferably from galvanized steel or stainless steel, which preferably have an L-shaped cross section or are hollow profiles with a square, rectangular, round or oval cross section which give the retaining frame (1) mechanical strength. If the retaining frame (1) has a base (9), the metal profiles (12) are preferably secured on this base and form the edges of the cuboid located above the base.

On the bottom side the retaining frame (1) preferably has receivers (13) for the forks of a forklift truck, in order to prevent the transport container falling down in the event of transport with a forklift truck. If the retaining frame (1) comprises a base (9), then the receivers (13) are preferably disposed below this base, in order to prevent the liquid container (2) being damaged when a forklift truck is deployed.

The retaining frame (1) preferably has latticed or closed sidewalls, in order to prevent damage to the liquid container (2) and also to the pressure equalization device (3) and the pressure relief valve (4) during transport. For the same purpose, the retaining frame (1) preferably additionally comprises a latticed or continuous lid (14), which can be opened and which in the closed state can be locked. The sidewalls of the retaining frame (1) preferably have an area for the mounting of an information panel, more preferably an area having a closable door to protect the information panel.

The retaining frame (1) may also have carrying eyelets (15) on the top face for the lifting of the transport container, these eyelets enabling simple and reliable loading of the transport container using a crane.

The cuboidal retaining frame (1) of the transport container of the invention may additionally have receivers for a mounting device, on the base or on a metal profile at a bottom edge, said mounting device allowing it to be held in place on the loading area of a vehicle, such as a truck or a railroad wagon, for example. It may be held in place in this case, for example, by claws or bolts which engage into the receivers, or by belts which are guided through the receivers and subsequently tightened.

Figure 2:
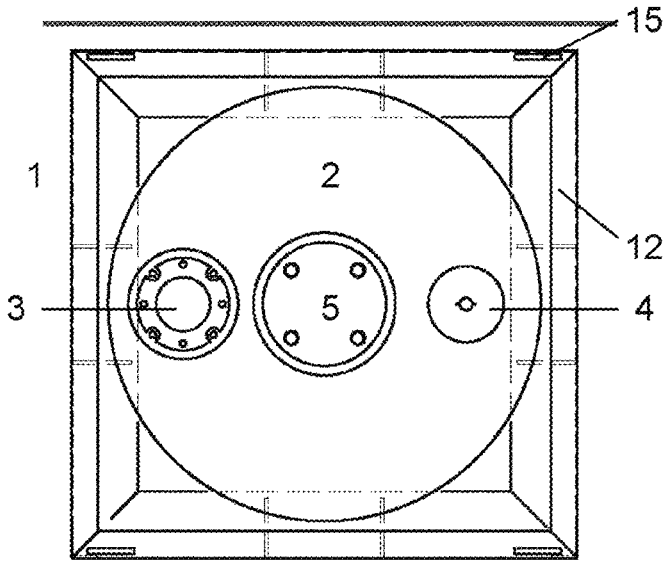
FIG. 2 shows a view from above of the transport container of FIG. 1

FIG. 1 shows one preferred embodiment of the transport container of the invention in side view; FIG. 2 shows the same container as viewed from above. The transport container comprises a cuboidal retaining frame (1) and, disposed therein, a liquid container (2) which has the form of a vertical cylinder (6) with domed base (7) and lid (8) and which has a circumferential ring (10) with which it stands up on the base (9) of the retaining frame (1). The liquid container (2) is connected frictionally to the retaining frame (1) by a clamping ring (11) placed around the cylinder (6). Disposed on the top face of the liquid container (2) are a pressure equalization device (3), a pressure relief valve (4) and an opening (5) which can be closed with a lid for charging with hydrogen peroxide and for removal of hydrogen peroxide. The cuboidal retaining frame (1) has metal profiles (12) with an L-shaped cross section which are secured on the base (9) and which form the edges of the cuboid located above the base (9). The retaining frame (1) also has a lid (14), which can be locked, and also carrying eyelets (15) for the lifting of the transport container, and receivers (13) for the forks of a forklift truck, below the base (9). In order to improve the clarity of the representation, the latticed sidewalls of the retaining frame (1) and the lattice form of the lid (15) are not shown in FIGS. 1 and 2.

LIST OF REFERENCE SYMBOLS

1 Cuboidal retaining frame
2 Liquid container made of pure aluminum
3 Pressure equalization device
4 Pressure relief valve
5 Opening for charging with hydrogen peroxide and/or removal of hydrogen peroxide
6 Vertical cylinder of the liquid container
7 Domed base of the liquid container
8 Domed lid of the liquid container
9 Base of the retaining frame
10 Circumferential ring on the liquid container
11 Clamping ring
12 Metal profiles of the retaining frame
13 Receivers for the forks of a forklift truck
14 Lid of the retaining frame
15 Carrying eyelets of the retaining frame

The invention claimed is:

1. A transport container for concentrated hydrogen peroxide, comprising:

(a) a cuboidal retaining frame;

(b) a liquid container disposed within the retaining frame, frictionally connected to the retaining frame, having an internal volume of 65 to 500 liters, and selected from the group consisting of: at least 99 wt % aluminum; chromium-nickel steel; a nickel-base alloy containing molybdenum and chromium; and steel that is lined or coated with a polyolefin on the inside;

(c) a pressure equalization device disposed on the top face of the liquid container, wherein the pressure equalization device enables the passage of gas between the container interior and the atmosphere surrounding the liquid container and enables pressure equalization in the case of a pressure difference of less than 50 mbar;

(d) a pressure relief valve disposed on the top face of the liquid container; and (e) at least one closable opening of the liquid container for charging with hydrogen peroxide and/or removal of hydrogen peroxide.

2. The transport container of claim 1, wherein the liquid container has the form of a vertical cylinder with a domed base and a lid.

3. The transport container of claim 2, wherein the retaining frame comprises a base and, at the bottom end of the liquid container, a circumferential ring is mounted which stands up on the base of the retaining frame.

4. The transport container of claim 3, wherein the liquid container is connected frictionally to the retaining frame by a clamping ring placed around the cylinder.

5. The transport container of claim 3, wherein the retaining frame comprises metal profiles mounted on the base which form the edges of the cuboid located above the base.

6. The transport container of claim 5, wherein the metal profiles have an L-shaped cross section or are hollow profiles with a square, rectangular, round or oval cross section.

7. The transport container of claim 1, wherein the liquid container has an internal volume of 65 to 250 liters.

8. The transport container of claim 1, wherein the liquid container is at least 99.5 wt % aluminum.

9. The transport container of claim 1, wherein the liquid container consists of steel, lined or coated with a fluorinated polyolefin on the inside, the fluorinated polyolefin being selected from the group consisting of:

polytetrafluoroethylene (PTFE); polyvinylidene difluoride (PVDF); and tetrafluoroethylene-perfluoroalkoxyvinyl ether copolymer (PFA).

10. The transport container of claim 1, wherein the liquid container is connected to the retaining frame via at least one shock absorber.

11. The transport container of claim 1, wherein the retaining frame has receivers on the bottom side for the forks of a forklift truck.

12. The transport container of claim 1, wherein the retaining frame has latticed or closed side walls.

13. The transport container of claim 12, wherein the retaining frame additionally comprises a latticed or continuous lid which can be opened and which, in the closed state, can be locked.

14. The transport container of claim 1, wherein the retaining frame has carrying eyelets on the top face for lifting the transport container.

15. The transport container of claim 1, wherein the pressure relief valve opens when a limiting value for an overpressure in the liquid container relative to the surrounding atmosphere in the range from 0.1 to 2.5 bar is exceeded.

16. The transport container of claim 15, wherein the pressure relief valve closes again automatically when the value for the overpressure falls below the limiting value.

17. The transport container of claim 1, wherein the pressure equalization device comprises a particle filter.

18. The transport container of claim 4, wherein the retaining frame comprises metal profiles mounted on the base which form the edges of the cuboid located above the base.

19. The transport container of claim 18, wherein the liquid container is at least 99.5 wt % aluminum.

20. The transport container of claim 18, wherein the liquid container consists of steel, lined or coated with a fluorinated polyolefin on the inside, the fluorinated polyolefin being selected from the group consisting of:

polytetrafluoroethylene (PTFE); polyvinylidene difluoride (PVDF); and tetrafluoroethylene-perfluoroalkoxyvinyl ether copolymer (PFA).

* * * * *